US008793975B2

(12) United States Patent
Kuentzle et al.

(10) Patent No.: US 8,793,975 B2
(45) Date of Patent: Aug. 5, 2014

(54) DEVICE AND METHOD FOR DIAGNOSING A TECHNICAL APPARATUS

(75) Inventors: Matthias Kuentzle, Schwieberdingen (DE); Joerg Kieser, Bietigheim (DE)

(73) Assignee: Robert Bosch GmbH, Stuttgart (DE)

( * ) Notice: Subject to any disclaimer, the term of this patent is extended or adjusted under 35 U.S.C. 154(b) by 235 days.

(21) Appl. No.: 11/528,222

(22) Filed: Sep. 26, 2006

(65) Prior Publication Data

US 2007/0083321 A1 Apr. 12, 2007

(30) Foreign Application Priority Data

Sep. 26, 2005 (DE) ..... 10 2005 045 932

(51) Int. Cl.
*F01N 3/00* (2006.01)

(52) U.S. Cl.
USPC ..... 60/277; 60/274; 60/276; 60/285; 701/107; 701/109; 701/115

(58) Field of Classification Search
USPC ..... 701/106, 107, 109, 114, 115; 60/274, 60/276, 277, 285
See application file for complete search history.

(56) References Cited

U.S. PATENT DOCUMENTS

| | | | | |
|---|---|---|---|---|
| 5,727,383 | A * | 3/1998 | Yamashita et al. | 60/276 |
| 5,964,811 | A * | 10/1999 | Ishii et al. | 701/29 |
| 6,415,210 | B2 * | 7/2002 | Hozuka et al. | 701/31.4 |
| 6,711,891 | B2 * | 3/2004 | Kitamura et al. | 60/276 |
| 6,711,932 | B2 * | 3/2004 | Iwazaki et al. | 73/1.06 |
| 6,898,927 | B2 * | 5/2005 | Morinaga et al. | 60/284 |
| 2005/0033503 | A1 * | 2/2005 | Yamamoto | 701/114 |

FOREIGN PATENT DOCUMENTS

DE 10260721 7/2004

* cited by examiner

*Primary Examiner* — Binh Q Tran
(74) *Attorney, Agent, or Firm* — Kenyon & Kenyon LLP

(57) ABSTRACT

A device and a method are provided for diagnosing a technical apparatus which is particularly developed as an internal combustion engine. When specified states of the technical apparatus are present, the means of diagnosis are activated, and when at least one of the specified technical states is no longer present, the means of diagnosis are deactivated. Upon the deactivation, information is stored that identifies which technical state is no longer present.

10 Claims, 1 Drawing Sheet

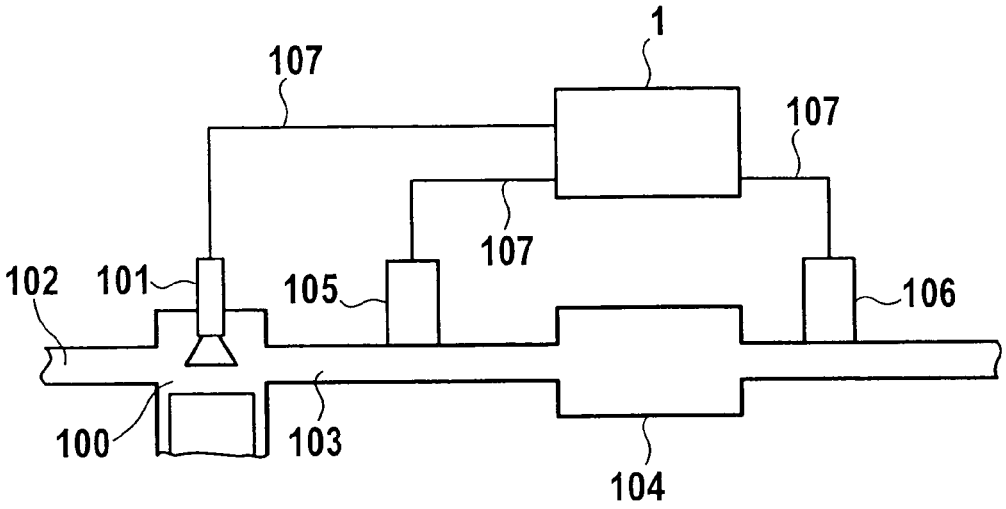
Fig. 1
Fig. 2
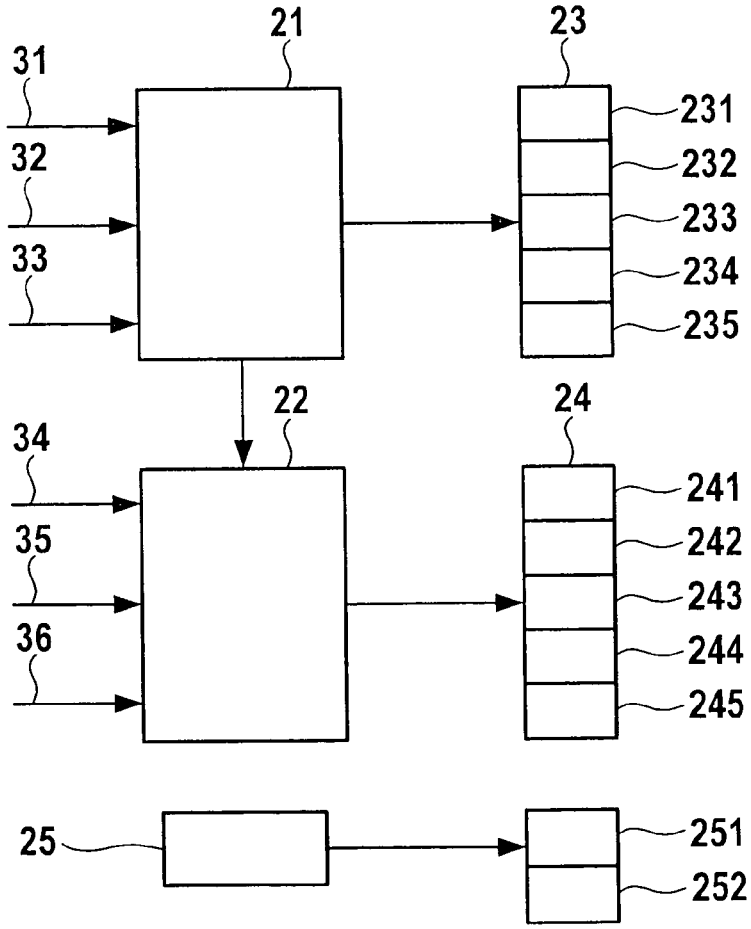

DEVICE AND METHOD FOR DIAGNOSING A TECHNICAL APPARATUS

BACKGROUND INFORMATION

A device and a method for diagnosing an internal combustion engine are described in German Patent Application No. DE 10260721 in which, in response to specified operating states of the internal combustion engine, a diagnosis function is activated. If the conditions are not present, the system waits until they are present.

SUMMARY OF THE INVENTION

The device according to the present invention and the method according to the present invention have the advantage that, based on the stored information, one is able to determine based on which of the technical circumstances a deactivation of the means of diagnosis and the diagnosis function takes place. Thus, in the operation of the technical device, one is able to determine which of the specified states are responsible for a repeated termination of the diagnosis of the technical device, and appropriate countermeasures may be initiated in order to ensure a sufficiently frequent control.

It makes sense that a diagnosis can only be carried out if the specified technical conditions are present for a specified minimum time period. Using a counter, it can be checked how often the diagnosis has been successfully completed. An additional counter is able to determine how often operating states exist which, based on legal regulations, require carrying out a diagnosis of the technical device. The number of successful diagnoses can then be compared with the number of legally required diagnoses.

BRIEF DESCRIPTION OF THE DRAWINGS

FIG. 1 shows a schematic view of an internal combustion engine having an exhaust gas system and a control unit.

FIG. 2 shows method steps of a method for diagnosing a technical device.

DETAILED DESCRIPTION

In FIG. 1, an internal combustion engine is shown schematically, having a combustion chamber 100 into which a fuel is injected by an injection 101. Furthermore, air has been introduced into combustion chamber 100 by an air supply 102. The fuel introduced into combustion chamber 100 by injection 101 is combusted in combustion chamber 100, and the combustion products resulting from this are removed by an exhaust pipe 103. A catalytic converter 104 is provided in exhaust pipe 103, by which the exhaust gases are purified. A lambda sensor 105 is provided upstream of catalytic converter 104, which analyzes the composition of the exhaust gas products in exhaust pipe 103. This lambda sensor is able, in particular, to determine the residual content of oxygen in the exhaust gas, and, with respect to the air quantity, is thus able to determine whether an excess of fuel or an excess of available air was available. It is desirable, in this context, that the air/fuel ratio, with reference to the oxygen required for the combustion, is exactly 1, since the smallest quantity possible of exhaust gases is created which, in addition is able to be purified especially well by catalytic converter 104. Downstream from catalytic converter 104 in exhaust pipe 103, there is situated an additional lambda sensor 106 which measures the oxygen content of the exhaust gas downstream from catalytic converter 104. In this context, lambda probe 105 is designed in such a way that a lambda content is able to be determined very rapidly over a wide range, while probe 106 is designed in such a way that, downstream from the catalytic converter, an accurate determination in a range about a stoichiometric mixture composition (that is, lambda=1) is accurately investigated.

The measured values of the different sensors 105, 106 are reported to an engine control unit 1 via lines 107. Based on sensor signals, engine control unit 1 calculates command signals and, for instance, also a command signal for fuel injector 101, which is activated over appropriate lines 107. Besides the sensors and actuators shown here, in a real engine, mounted, for example, in a motor vehicle, a multitude of sensors and actuators are provided.

In the exhaust system shown in FIG. 1, the sensors have to be checked from time to time for their operability. Various legal institutions even provide that such tests have to occur routinely, at a certain frequency, during normal driving operation. For this purpose, however, an appropriate diagnosis function can only be carried out if certain operating conditions of the internal combustion engine are implemented. If a case is involved in which the provided frequency of carrying out the diagnosis functions is not achieved, the question arises whether, perhaps, individual operating conditions, which are regarded as being required for carrying out the diagnosis, interfere with an activation of the means of diagnosis in sufficient measure. If, in this context, a correct processing of the diagnostic function is frequently caused by change in a technical state, then it may be attempted to carry out the diagnosis more frequently by changing the diagnostic function.

The method according to the present invention will be explained schematically, in the light of the figure, using the example of checking first lambda probe 105, upstream of catalytic converter 104. In a first program block 21, general enabling requirements for a diagnosis or a diagnosis of this first lambda sensor 105 are scanned. In this context, a first initial condition is a general enabling 31. This bit of the general enabling 31 is always set when a regular operating state of the internal combustion engine exists, that is, the internal combustion engine has been operated for a certain minimum time period and there are no general faults present in the control of the internal combustion engine, such as a faulty load sensor, or the like. As a further condition, an input bit 32 is investigated which is set only if there has already been a sufficiently long driving operation. An additional condition is that rear lambda sensor 106, which is important for the diagnosis of front lambda sensor 105, is operational. Therefore, as a further initial condition, functional readiness bit 33 of the rear lambda sensor is checked, which is done only if, in response to a previously executed function test of the rear lambda probe, the operability in principle of this lambda probe was determined.

These general initial conditions are now used in program block 21 in order to set appropriate indicator bits in a memory 23 controlled by program block 21. The setting of the bits in memory 23 takes place only once per driving operation, in this instance, that is, for each initial operation of the internal combustion engine an appropriate bit is set once in memory 23. Subsequently, by checking the content of memory 23, it can then be determined whether, during the corresponding driving cycle of the internal combustion engine initial conditions 31, 32 and 33 were present, which means that, generally, diagnosing front lambda probe 105 was possible. If general enabling bit 31 was set at least once during the driving cycle, a corresponding bit will be set in memory location 231. In the driving cycle, if bit 32 was determined to have been set, program block 21 sets corresponding bit 232 in memory 23. If bit 33 was set, bit 233 is set in memory 23. If, at any time in the operation of the internal combustion engine, both bit 31 and bit 32 were set at the same time, the bit is set in memory 234. By scanning this bit, one can determine whether, during the running operation of the internal combustion engine, general enabling bit 31 was enabled at least for one operating state, and simultaneously a sufficiently long operation of the internal combustion engine was present.

If this operating state was present, and it was determined at the same time that bit 33 had been set, that is, that rear lambda probe 106 had been judged to be operational, bit 235 is set. Consequently, this bit indicates that all the initial conditions 31-33 were present at at least one time in the operation of the internal combustion engine. By scanning the individual bits in memory 23, one can consequently understand very accurately whether, during the running operation of the internal combustion engine, an operating state was present at least once in which diagnosing front sensor 105 was possible. In general, the situation is that when all suppositions are present, diagnosing the sensor is attempted.

A further program block 22 follows program block 21, in which additional states are investigated that are required for diagnosing lambda sensor 105. In program step 22, especially technical states of the internal combustion engine are investigated which are conditioned upon the operation of, or the requirements upon the internal combustion engine. For, only if certain states are present, is a meaningful diagnosis of the operability of first lambda sensor 105 possible. A first condition checked by program block 22 is the presence or the non-presence of a deceleration fuel cutoff 34. During the deceleration fuel cutoff, in response to a running operation of the internal combustion engine, the injection of fuel is interrupted, since, for instance, a vehicle in which the engine is installed is currently in an overrun phase. Since no fuel is injected during this time, the exhaust gas also has the normal oxygen content of the air, and a corresponding signal of lambda probe 105 cannot be meaningfully checked as to whether it is functioning properly. Load dynamics 35 are checked as an additional initial condition.

In response to a very rapid operation of the accelerator by the driver, the charge of air in combustion chamber 100 changes very rapidly, which leads from time to time to an air quantity that is not adjusted relatively to the fuel injected by injection 101. Therefore, in this operating state, too, it is not possible to make a meaningful diagnosis of first lambda probe 105. As an additional condition, it is then checked whether the air flow of the air flowing into combustion chamber 101 lies within a meaningful range. A certain enrichment of the mixture is provided especially in response to a very high load, that is, a very high quantity of air flowing into combustion chamber 100, which then also makes impossible diagnosing lambda sensor 105. Because of the conditions scanned in program block 22, a diagnosis that is possible in principle is obstructed. During an operating phase of the internal combustion engine, the occurrence of a deceleration fuel cutoff, load dynamics or an unsuitable rate of air flow may come about repeatedly.

A corresponding memory 24 is provided, in which it is recorded by program block 22 how often a diagnosis, that is possible in principle, has been obstructed or a diagnosis already begun has been terminated, based on the various initial conditions of program block 21. For this purpose, individual bits in memory 24 are not influenced, but the storage locations of memory 24 are developed as counters. In memory location 241 a counter is stored which indicates how often a running diagnosis has been terminated based on a deceleration fuel cutoff. In memory location 242 a counter is stored which is always incremented when a running diagnosis has been terminated based on load dynamics 35. In storage location 243 a counter is stored which is always incremented if a diagnosis has been terminated based on an air flow rate that was too low or too high, that is, initial condition 36. Memory locations 244 and 245 may, in turn, include counters which are always incremented when combinations of initial conditions 34, 35 and 36 are present.

After an operation of the internal combustion engine it can be ascertained, by scanning the bits stored in memories 23 and 24, or the counter readings, based on which initial assumptions, or based on the absence of which initial assumptions, a diagnosis or a diagnosis of first lambda probe 105 did not happen in the expired operating cycle of the internal combustion engine. If, in this situation, a certain assumption turns out to be that the non-occurrence of a diagnosis is especially fair as to cause, an attempt can be made to increase the frequency of carrying out the diagnosis by changing the diagnostic function. For instance, it can be provided to admit the deceleration fuel cutoff 34 only in response to a lower number of operating states, and thereby to increase the frequency of the successful run through of the diagnostic function.

In this context, it may naturally also make sense to investigate the presence or absence of initial assumptions 31-36, over a plurality of operating cycles of the internal combustion engine. In order to do this, it is then meaningful to use the storage content of memory 23, at the end of each operating cycle of the internal combustion engine, in order to increase counters for these bit states. The content of memory status 24 at the end of each operating cycle can simply be added to an already present counter, for these operating states. In this way, evidence can be presented as to how suitable conditions have been present, over a plurality of operating cycles of the internal combustion engine, for a diagnosis or a control function of first lambda probe 105.

In addition, one more program block 25 is provided which is always called up when the diagnosis or the diagnostic function was executed successfully. In response to each successful run-through of the diagnosis or the diagnosis function, a counter 251 is incremented by program block 25, whose count value thus states how often the diagnosis or diagnostic function was successfully completed. Moreover, one further counter 252 is provided whose count value is always incremented when further operating states of the internal combustion engine have been present. For example, the count value of counter 252 can always be incremented when an overall operating duration of the internal combustion engine of at least 600 seconds was completed, and during this time, at least one continuous idling proportion of at least 30 seconds was present, and for at least 300 seconds the motor vehicle, in which the internal combustion engine is installed, was moved at a speed of more than 40 km/h. These further operating conditions of the internal combustion engine are standard operating conditions, which were specified by a controlling authority. In relationship to the occurrence of these standardized operating conditions of the internal combustion engine, a specified number of diagnoses or diagnostic functions of the internal combustion engine have to be successfully completed. For example, it may be provided that the count value of the counter of the successful diagnoses 251 should amount to at least 10%, and in the case of more stringent requirements, even 30% of the count value of counter 252. By comparing these two counters, it is consequently ensured that a diagnosis of the internal combustion engine is carried out sufficiently frequently so as reliably to ensure an operation of the internal combustion engine, or rather the motor vehicle, that is optimized with respect to pollutants.

What is claimed is:

1. A device for diagnosing an internal combustion engine, comprising:

a diagnosis device configured as an electronic control unit adapted to initiate a diagnosis process of the internal combustion engine during operation of the internal combustion engine when predetermined states of the internal combustion engine required for the initiation of the diagnosis process are present, and wherein the diagnosis device is further adapted to subsequently terminate the diagnosis process prior to successful completion of the diagnosis process when at least one of the predetermined states of the internal combustion engine required for the initiation of the diagnosis process is no longer present; and an arrangement for storing, upon the termination of the diagnosis process nor to successful completion of the diagnosis process, information that identifies which of the predetermined states of the internal combustion engine required for the initiation of the diagnosis process is no longer present.

2. The device according to claim 1, wherein the diagnosis device successfully completes the diagnosis process of the internal combustion engine only when the predetermined states of the internal combustion engine required for the initiation of the diagnosis process are present for a first predetermined time period.

3. The device according to claim 2, wherein the diagnosis device has a first counter which is incremented when the diagnosis process has been successfully completed.

4. The device according to claim 3, further comprising a second counter which is incremented when two states of the internal combustion engine are present for a second predetermined time period.

5. The device according to claim 4, wherein at least one of (a) the first and second counters are checked and (b) a ratio of the first and second counters is checked.

6. A method for operating a diagnosis device configured as an electronic control unit for diagnosing an internal combustion engine, comprising:

initiating a diagnosis process of the internal combustion engine by the diagnosis device during operation of the internal combustion engine when predetermined states of the internal combustion engine required for the initiation of the diagnosis process are present;

subsequently terminating the diagnosis process prior to successful completion of the diagnosis process by the diagnosis device when at least one of the predetermined states of the internal combustion engine required for the initiation of the diagnosis process is no longer present; and upon the termination of the diagnosis process prior to successful completion of the diagnosis process, storing in a memory medium information that identifies which of the predetermined states of the internal combustion engine required for the initiation of the diagnosis process is no longer present.

7. The method according to claim 6, wherein the diagnosis device successfully completes the diagnosis process of the internal combustion engine only when the predetermined states of the internal combustion engine required for the initiation of the diagnosis process are present for a first predetermined time period.

8. The method according to claim 7, further comprising incrementing a first counter of the diagnosis device when the diagnosis has been successfully completed.

9. The method according to claim 8, further comprising incrementing a second counter when two states of the internal combustion engine are present for a second predetermined time period.

10. The method according to claim 9, further comprising checking at least one of (a) the first and second counters and (b) a ratio of the first and second counters.

* * * * *